United States Patent [19]

Kuramoto

[11] Patent Number: 5,016,459

[45] Date of Patent: May 21, 1991

[54] METHOD AND GUIDE ROLL STAND FOR GUIDING AND SHAPING STRIP MATERIAL IN A PIPE MILL

[75] Inventor: Ryosuke Kuramoto, Tondabayashi, Japan

[73] Assignee: Nakata Manufacture Company Limited, Osaka, Japan

[21] Appl. No.: 368,313

[22] PCT Filed: Dec. 23, 1987

[86] PCT No.: PCT/JP87/01016

§ 371 Date: Jun. 14, 1989

§ 102(e) Date: Jun. 14, 1989

[87] PCT Pub. No.: WO88/04968

PCT Pub. Date: Jul. 14, 1988

[30] Foreign Application Priority Data

Dec. 26, 1986 [JP] Japan ..... 61-313975
Feb. 10, 1987 [JP] Japan ..... 62-28889

[51] Int. Cl.[5] ..... B21D 5/14; B21D 5/12

[52] U.S. Cl. ..... 72/178; 72/52; 72/182

[58] Field of Search ..... 72/51, 52, 178, 181, 72/182, 224, 225; 228/17, 17.5, 147, 151

[56] References Cited

FOREIGN PATENT DOCUMENTS 1016675 10/1957 Fed. Rep. of Germany ..... 72/182
2608410 9/1977 Fed. Rep. of Germany .
2348761 11/1977 France .

*Primary Examiner*—E. Michael Combs
*Attorney, Agent, or Firm*—Laurence R. Brown

[57] ABSTRACT

A pair of slit type horizontal fin rolls (18) and a pair of vertical side rolls (19) having such a shape as having the conventional vertical side roll (19) formed by contracting its center portion are utilized, and due to the construction in which one set of each horizontal fin roll (18) and vertical side roll (19) adjustable horizontally, the depressing force is not applied to the material, and since the edge is restrained and shifted widthwise only with the horizontal force of the vertical side rolls (19) rotating freely, threading can be conducted very smoothly irrespective of the sectional shape of the material after break down, and even if the material size is changed, the threading can be conducted very smoothly without adjusting the roll position as strictly as in the past.

2 Claims, 5 Drawing Sheets

METHOD AND GUIDE ROLL STAND FOR GUIDING AND SHAPING STRIP MATERIAL IN A PIPE MILL

The present invention relates to a method and roll stand for guiding strip material to a fin-pass rolls of a pipe mill for producing thin pipe, such as seam welded steel pipe.

In general, when producing pipe in a pipe mill, a strip of material is first formed into a semicircular shape with break down rolls, then its center portion is formed with cluster rolls and fed to squeeze rolls after adjusting the edge angle and finishing and centering with fin-pass rolls in preparation for welding.

The shaping by the fin-pass rolls is decisive to the quality of the final product, and consideration must be given to prevent such strains as edge stretch, edge buckling and roll marks, and various types of fin-pass rolls have been proposed.

On the other hand, the material which has been formed in the break down or cage rolls, proceeds in a state wider than at forming due to spring back, and since horizontal movement of the edges is larger than the rest of the material, guidance or threading to the fin-pass rolls may not conducted smoothly, requiring more time for the material to be gripped by the fin-pass rolls.

Also, when the material is fed into the fin-pass rolls, forming is effected by halved or quartered rolls, but since the sectional shape of the material before the fin-pass rolls is not the final shape, due to the insufficient forming, the material is susceptible to contact flaws caused by the difference in circumferential velocity arising from the difference between the center and end diameters of the roll.

In the past, in order to avoid such slip flaws, pipe mill provided with an edge guide roll stand, in which pairs of vertical rolls and edge guide rolls with a V-shaped section, disposed upstream of the fin-pass roll stand, has been proposed in Japanese patent No. 53447/81.

A method of producing seam welded steel pipe, wherein the edge portion is restrained for forming with the V roll at the front of the fin pass, thus improving the formability and reducing the gap between the cage rolls and fin pass rolls, has been proposed in Japanese published patent application No. 166321/84.

This aforementioned prior art are both efficacious for correcting insufficient forming of the sectional shape of the material before passing into the fin pass rolls. But, at threading of the material end, as shown in FIG. 6, since the horizontal V roll 30 rotates to restrain the material edge 21 and a large angle appears between the tangential direction F of the frictional force and the moving direction S of the material 20, a component D of the frictional force is produced and acts to depress the edge portion 21 and shift it horizontally. As a result, slipping takes place on the roll face, producing edge wave and stretch, particularly in the case of thin steel pipe.

Also, in order to facilitate the threading, the V of the roll must be deep. However, if the V roll is deep, the material is susceptible to roll marking so the roll diameter must be reduced or a plurality of V rolls must be used, resulting in difficulty of adjusting the roll position and eventually of avoiding the edge stretch and scratching.

Taking into account such a situation in a pipe mill, it is an object of the present invention to provide a method of guiding material to fin-pass rolls and a guide roll stand therefor, which largely facilitates gripping of the material at threading, preventing the edge stretch and scratch, having a high correcting effect to the desired circular shape and suitable for producing thin steel pipes.

According to the present invention, in a method of forming a pipe by bending a strip of material in a pipe mill, the step of guiding the material to fin-pass rolls comprises bending edge portions of the U-shaped material inwardly towards one another by a pair of coaxial, axially spaced, frusto conical horizontal rolls, which contact respective edge faces of the material, and by a pair of vertical rolls the axes of which are orthogonal to and intersect the axis of the horizontal rolls, and which contact the outwardly facing surfaces of the edge portions, leaving the material unsupported below its maximum width except for a further horizontal roll which contacts the under surface of the central bottom portion of the material.

The present invention also includes a guide roll stand for use on the upstream side of fin-pass rolls in a pipe mill, the stand comprising a main frame of which the height is vertically adjustable; a face plate which is removably mounted in the frame; a bottom roll which is vertically adjustably mounted in the face plate for supporting the under surface of the central bottom portion of a U-shaped strip of pipe material; two roll frames horizontally adjustably mounted within respective sides of the face plate and each carrying both a horizontal roll, for contacting a respective edge face of the material, and a vertical roll, the axis of which is orthogonal to and intersects the axis of the respective horizontal roll, for contacting the outwardly facing surface of the respective edge portion of the material but leaving the material unsupported below its maximum width except by the bottom roll.

In the present invention, a pair of split horizontal rolls and a pair of vertical side rolls having a shape corresponding to a half of a conventional vertical side roll with a reduced diameter center portion are utilized. Since no significant depressing force is applied to the material and the edge portions are restrained and shifted horizontally only by horizontal forces from the freely rotating vertical side rolls, there is the advantage as that threading is conducted very easily, irrespective of the sectional shape of the material after break down. When the material size is changed, it may be accommodated very easily without adjusting the roll position as strictly as in the past.

In detail, in the present invention, as shown in FIG. 4, the horizontal rolls 18,18 contact the edge face of the material 20 and the vertical side roll 19,19 on the vertical shafts contact the edge portions 21. Each set of one horizontal roll 18 and one vertical side roll 19 is arranged on the orthogonal shafts and rotate freely. Since the tangential direction F of the frictional force and the moving direction S of the material 20 is generally the same, a component D of the frictional force is hardly produced and the edge portions 21 are not influenced by any significant depressing forces, but only horizontal forces so that the production of edge waves and stretches which were apt to occur using the conventional V rolls, particularly in the production of the thin steel pipes, as well as the prior art problem of scratches produced on the material, may be prevented.

Also, as shown in FIG. 5, even if the sectional shape of the material 20 after break down is highly oval, the intermediate portions of the material 20 may be expanded and formed into the necessary circular shape by a biasing force of the bottom roll 11. Thus the amount of contraction in the fin-pass rolls may be reduced.

Also, since each set of horizontal roll and vertical side roll is adjustable horizontally, and the position where the material edge portions contact the surfaces of the vertical side rolls is adjustable owing to the structure in which the entire face plate can be moved vertically, even when the material size is changed, to some extent rolls may be used commonly.

Furthermore, each roll can be adjusted very easily and freely. Thus by preparing a plurality of face plates, mounted with rolls for various pipe diameters, in advance and exchanging them, the production of various types of pipes in small quantities can be obtained easily.

In the present invention, the horizontal rolls may be of a non-driven or driven type.

Figure 4A:
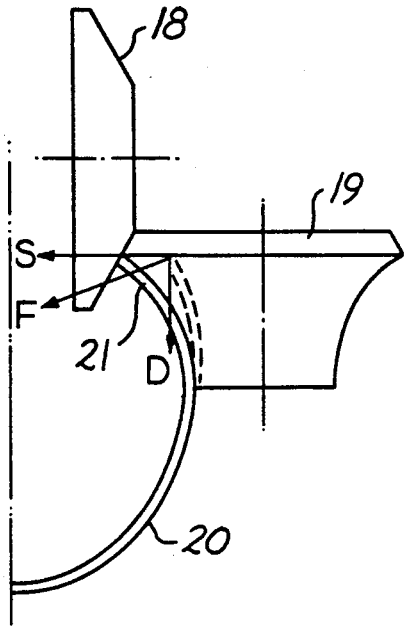
Figure 4B:
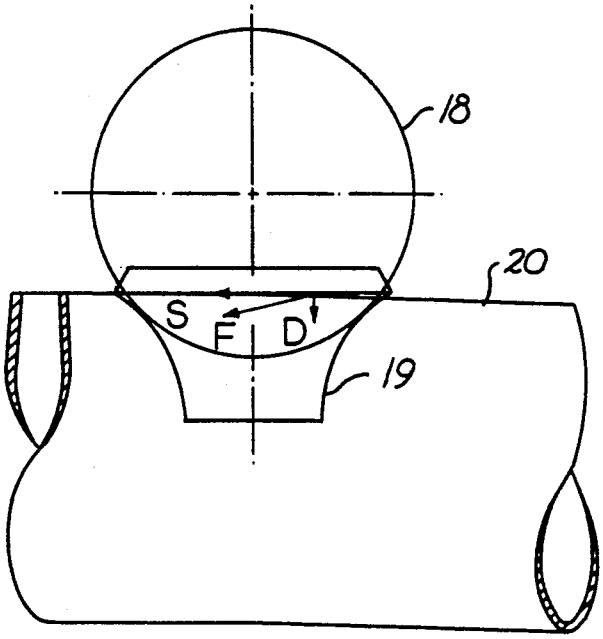
Figure 4C:
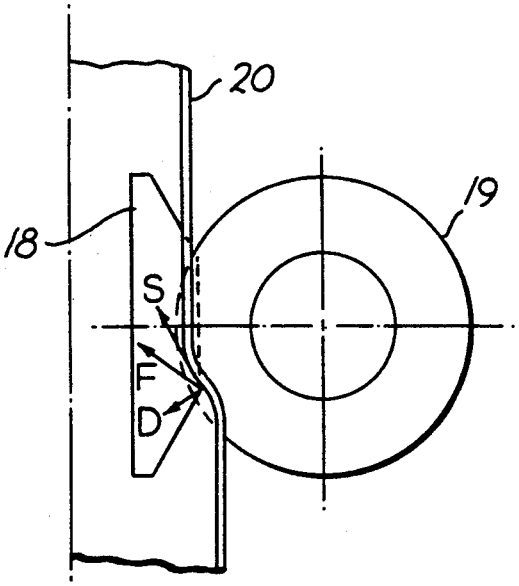
Figure 5:
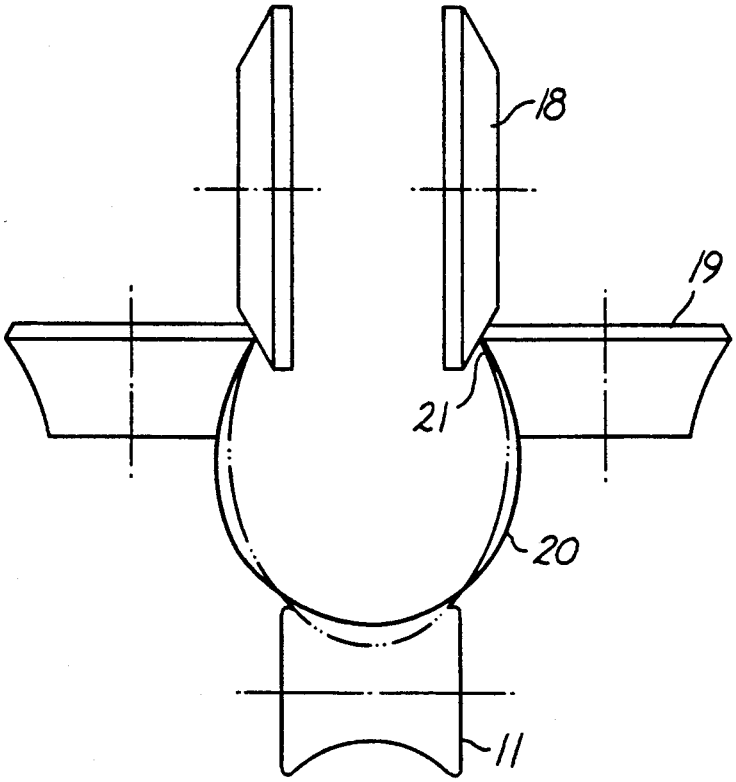
Figure 6A:
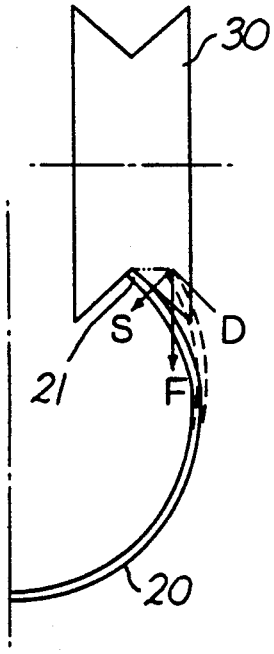
PRIOR ART FIG. 6(a)
Figure 6B:
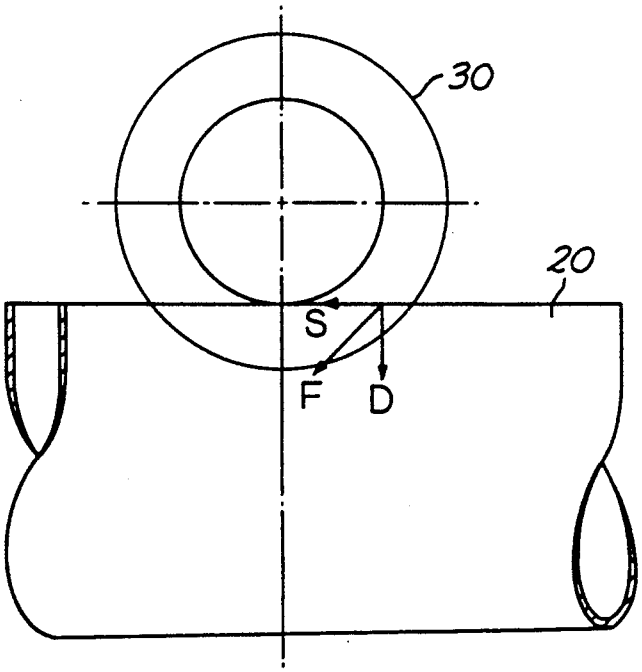
PRIOR ART FIG. 6(b)

FIGS. 4*a, b, c* and FIG. 5 are illustrative views showing the relationship between a guide roll according to the present invention and a material edge portion; and, FIGS. 6*a, b* are illustrative views showing the relationship between a conventional horizontal V roll and a material edge portion.

Figure 1:
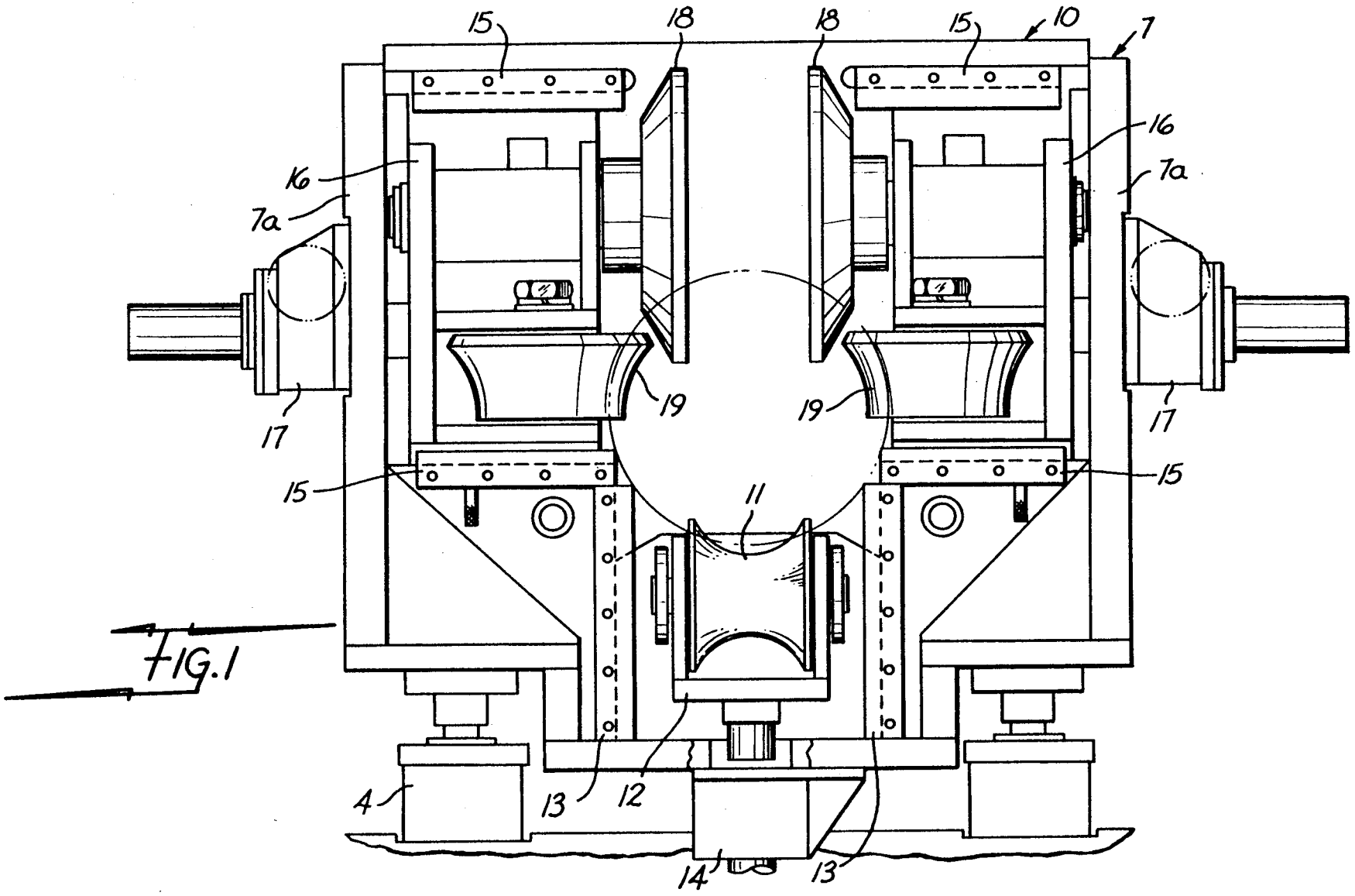
FIG. 1 is a front view illustrating a face plate and a frame mounted with guide rolls of a guide roll stand according to the present invention.
Figure 2:
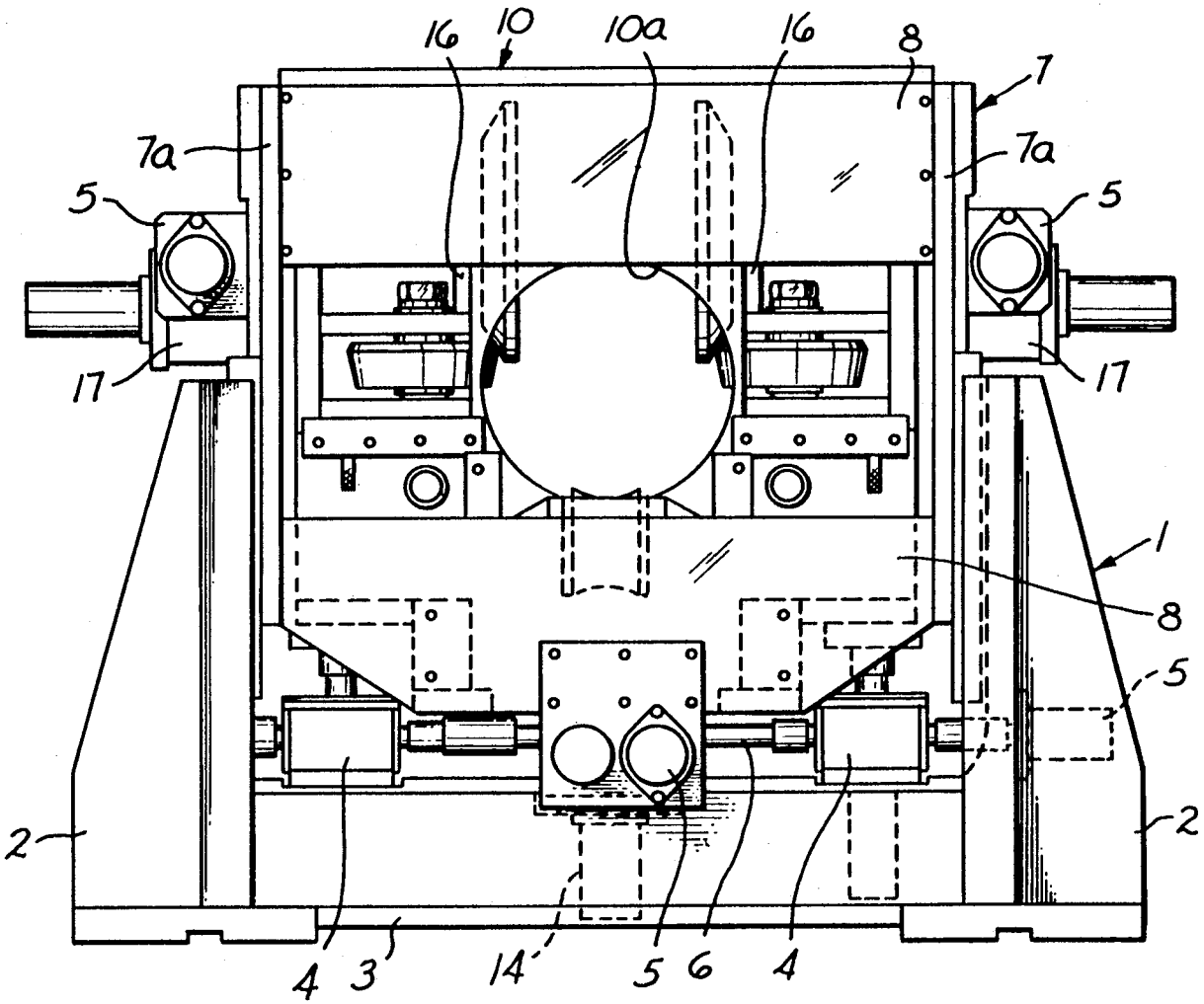
FIG. 2 and FIG. 3 are front and plan views illustrating a guide roll stand according to the present invention.
Figure 3:
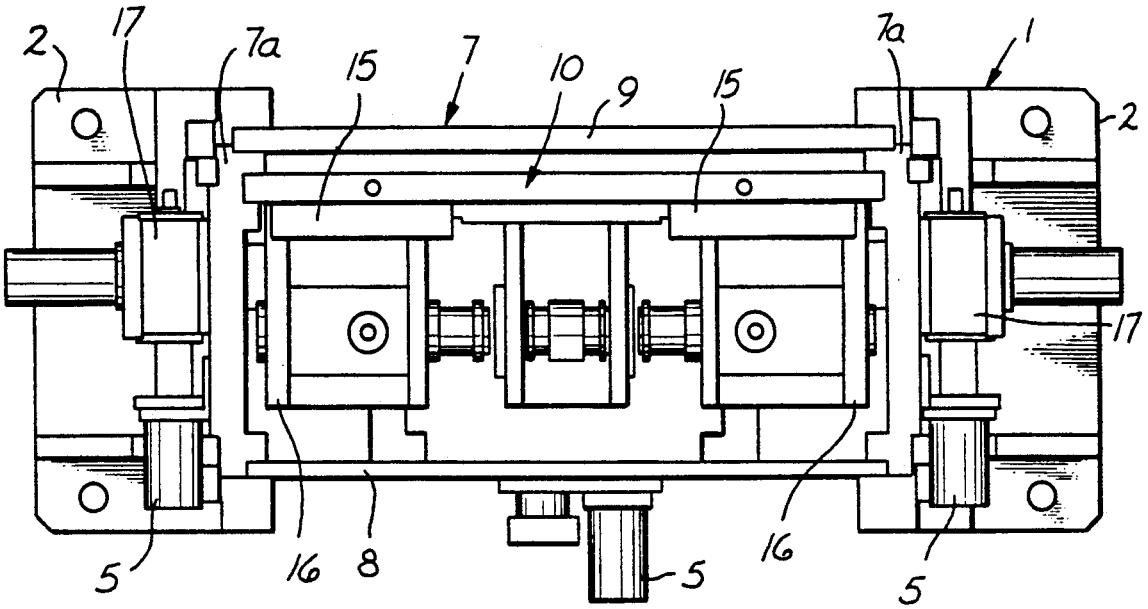

As shown in FIGS. 1 and 2, a guide roll stand 1 comprises a pair of leg portions 2, 2 and a base portion 3 connecting them. Opposite sides of a frame 7, having a rectangular sectional shape and incorporating a face plate 10, to which rolls are mounted, between the leg portions 2,2 and are vertically movable relatively thereto.

Also, on the base portion 3, a pair of screw tacks 4,4 are provided for supporting and biasing both bottom ends of the frame 7 to adjust its height relatively to the base portion. In addition, a connecting shaft 6 is provided between the pair of screw jacks 4,4, which are driven by an oil hydraulic motor 5 via a worm gear.

The frame 7 is constructed by assembling a main body 7*a* and steel components such as a plate members 8,9 and square bars, and on the opposed surfaces of the main body 7*a* on the sides of leg portions 2, 2, grooves are provided to accommodate the face plate 10 for mounting the rolls in the frame 7.

In the face plate 10, there is a center opening 10*a* through which the material is inserted, and around which various rolls are disposed.

That is, on the center of the bottom of the face plate 10, a horizontal receiving roll 11 for supporting the center portion of the material is carried by a supporting frame 12, which is engaged to vertical slide frames 13 so that its height is adjustable toward the center of the frame 7 by a screw jack 14 secured thereto.

Also, on the inner opposite sides of the face plate 10, spaced slide frames 15,15 are arranged at the upper and center portions respectively and carry respective horizontally slidable roll supporting frames 16,16 which are adjustable horizontally by screw jacks 17,17 secured to the outer opposite sides of the frame 7.

On the opposed sides of the supporting frames 16,16, are horizontal rolls 18,18 for supporting the material edge faces and in addition, vertical side rolls 19,19 fOr supporting the material edge portions are mounted on supporting shafts arranged orthogonally underneath the shafts of the horizontal rolls 18,18.

That is, the face plate 10, disposed for free movement on the frame 7 of the guide roll stand 1, carries the horizontal receiving roll 11, the horizontal rolls 18,18 and vertical side rolls 19,19, and is finely adjustable within a certain range corresponding to the size and shape of the material passing through the center opening 10*a* of the face plate 10. Also, a plurality of face plates 10 mounted with rolls for various pipe diameters may be prepared in advance.

The guide roll stand 1 constructed as described above is arranged between the break down or cage rolls and the fin-pass rolls.

When the material end is fed into the guide roll stand 1 after completing the break down, even if its sectional shape is highly oval and its edge portions are wide apart, owing to the vertical rolls 19,19 each consisting of the upper half of a conventional vertical roll, which is formed with a reduced diameter center portion and rotates freely, the material edges can be restrained almost without any accompanying downward pressure, so that the threading is conducted smoothly and edge waves are eliminated.

Also, as shown in FIG. 5, the material is apprehended by the horizontal rolls 18,18 at its edges 21,21 and its center portion is biased by the horizontal receiving roll 11 so as to be expansible into a circular shape, thus the material formed into the required sectional shape may be fed to the following fin-pass rolls, thus leaving only a small amount of contraction by the following fin-pass rolls.

I claim:

1. A guide roll stand for forming a pipe by bending a generally U-shaped strip (20) of material in a pipe mill, the stand comprising a main frame (7); means for vertically adjusting said mainframe in said stand; a face plate (10); means for removably mounting said face plate in the frame; a bottom shaping roll (11); means for vertically adjusting said bottom shaping roll in the face plate, said bottom shaping roll being positioned for supporting a bottom outer surface of said U-shaped strip (20) of pipe material being processed in said mill; two roll frames (16); means for horizontally adjusting said roll frames within the stand, each of said roll frames carrying both a fin-pass roll (18), for contacting and shaping a respective edge face (21) of the U-shaped strip, and a side roll (19) positioned with an axis orthogonal to and intersecting the axis of a respective fin-pass roll, each of said side rolls having shaping surface extending only from a respective edge face to a point above a maximum width of said U-shaped strip for contacting and shaping outwardly facing side surfaces of said U-shaped strip adjacent to the respective edge faces (21) of the U-shaped strip, said bottom shaping roll being positioned for supporting said U-shaped strip by contacting said bottom outer surface only in a region below said maximum width of said U-shaped strip.

2. A method of forming a pipe by bending a generally U-shaped strip (20) of material in a pipe mill comprising the steps of: guiding the U-shaped strip to a pair of coaxial, axially-spaced, frusto conical fin-pass rolls (18), bending edge portions (21) of said generally U-shaped strip so that edge faces of said U-shaped strip are directed inwardly towards one another by contacting respective ones of said edge faces with frusto conical shaping surfaces of said fin-pass rolls, while simultaneously shaping outwardly facing side surfaces of the U-shaped strip near said edge faces by contacting said side surfaces with shaping surfaces of a pair of side rolls (19) having axes orthogonal to and intersecting with axes of the fin-pass rolls said shaping surfaces of said side rolls extending only from said edge faces to a point above a maximum width of said U-shaped strip, supporting the U-shaped strip below said maximum width of said U-shaped strip and between said side surfaces during said bending and shaping only by a further shaping roll (11) which contacts the U-shaped strip at an outer surface of a bottom portion of the U-shaped strip between said side faces.

* * * * *